US007326320B2

(12) United States Patent
Scherb et al.

(10) Patent No.: US 7,326,320 B2
(45) Date of Patent: Feb. 5, 2008

(54) MACHINE FOR THE MANUFACTURE OF A FIBER MATERIAL WEB

(75) Inventors: Thomas Thoroe Scherb, Sao Paulo (BR); Harald Schmidt-Hebbel, Barueri (BR)

(73) Assignee: Voith Patent GmbH, Heidenheim (DE)

( * ) Notice: Subject to any disclaimer, the term of this patent is extended or adjusted under 35 U.S.C. 154(b) by 180 days.

(21) Appl. No.: 10/831,201

(22) Filed: Apr. 26, 2004

(65) Prior Publication Data

US 2004/0194904 A1 Oct. 7, 2004

Related U.S. Application Data

(62) Division of application No. 10/073,917, filed on Feb. 14, 2002, now Pat. No. 6,746,574, which is a division of application No. 09/471,369, filed on Dec. 23, 1999, now abandoned.

(30) Foreign Application Priority Data

Dec. 29, 1998 (DE) ..... 198 60 687

(51) Int. Cl.
*D21F 3/02* (2006.01)
*D21F 3/06* (2006.01)
*B30B 3/02* (2006.01)

(52) U.S. Cl. ..... 162/358.3; 162/358.1; 100/156

(58) Field of Classification Search ..... 162/109–117, 162/204–207, 358.1, 358.3, 358.5, 359.1, 162/360.2, 360.3, 375–379, 149; 100/37, 100/38, 156; 34/397–400
See application file for complete search history.

(56) References Cited

U.S. PATENT DOCUMENTS 4,036,679 A 7/1977 Back et al.
4,324,613 A * 4/1982 Wahren ..... 162/111
4,488,932 A 12/1984 Eber et al.

(Continued)

FOREIGN PATENT DOCUMENTS

DE 4224730 9/1993

(Continued)

OTHER PUBLICATIONS

Schuwerk, "NipcoFlex Shoe Presses for Writings and Printings—Concepts and Intial Operating Experience," Voith Sulzer Paper Technology, Presented at the PITA Conference "Water Removal 95," York, England (1995).

*Primary Examiner*—Eric Hug
(74) *Attorney, Agent, or Firm*—Greenblum & Bernstein, P.L.C.

(57) ABSTRACT

Machine for the manufacture of fiber material web with shoe pressing unit and drying or tissue cylinder arranged to form at least one press nip. Water absorbent carrier band and water-impermeable pressing band being guided through the at least one press nip, and fiber material web is adapted to pass through the at least one press nip with the water absorbent carrier band and the water-impermeable pressing band. The at least one press nip has a length in web travel direction of less than or equal to approximately 60 mm. Pressure profile results over press nip length having maximum pressing pressure greater than or equal to approximately 3.3 MPa. The instant abstract is neither intended to define the invention disclosed in this specification nor intended to limit the scope of the invention in any way.

5 Claims, 5 Drawing Sheets

U.S. PATENT DOCUMENTS

| | | | | |
|---|---|---|---|---|
| 4,976,820 | A * | 12/1990 | Laapotti | 162/206 |
| 5,043,046 | A | 8/1991 | Lappotti | |
| 5,092,962 | A | 3/1992 | Koski | |
| 5,164,047 | A | 11/1992 | Koski | |
| 5,795,440 | A | 8/1998 | Ampulski et al. | |
| 6,004,429 | A | 12/1999 | Schiel | |
| 6,083,349 | A | 7/2000 | Schiel | |
| 6,228,221 | B1 | 5/2001 | Loser et al. | |
| 6,248,210 | B1 * | 6/2001 | Edwards et al. | 162/111 |
| 6,350,349 | B1 | 2/2002 | Hermans et al. | |

FOREIGN PATENT DOCUMENTS

| | | |
|---|---|---|
| DE | 19654197 | 6/1998 |
| DE | 19654198 | 6/1998 |
| EP | 0289477 | 11/1988 |
| EP | 0852273 | 7/1998 |
| WO | 97/43483 | 11/1997 |
| WO | 98/00604 | 1/1998 |

* cited by examiner

MACHINE FOR THE MANUFACTURE OF A FIBER MATERIAL WEB

CROSS-REFERENCE TO RELATED APPLICATIONS

The present application is a divisional of U.S. patent application Ser. No. 10/073,917, now U.S. Pat. No. 6,746,574, filed Feb. 14, 2002, which is a divisional of U.S. patent application Ser. No. 09/471,369 filed Dec. 23, 1999, now abandoned, which claims priority under 35 U.S.C. § 119 of German Patent Application No. 198 60 687.7 filed Dec. 29, 1998, the disclosures of which are expressly incorporated by reference herein in their entireties.

BACKGROUND OF THE INVENTION

1. Field of the Invention

The invention relates to a machine for the manufacture of a fiber material web, in particular a tissue paper or hygienic paper web, having at least one pressing gap (nip) which is formed between a shoe pressing unit and a drying or tissue cylinder, and water absorbent carrier band, a water-impermeable pressing band and the fiber material web guided through the at least one gap. It also relates to a method for the manufacture of a fiber material web, e.g., a tissue or hygienic paper web, in which the fiber material web to be dewatered is passed together with a carrier band through a pressing gap (nip).

2. Discussion of Background Information

A plurality of embodiments of a machine of the initially named kind are described in DE-A-42 24 730. In this document, at least two pressing gaps are in each case provided in all embodiments. The main press, which lies to the rear when viewed in the direction of travel of the web, includes in each case a drying cylinder and an associated pressing element. A suction pressing roller or a shoe pressing roller can be provided as a pressing element of this kind.

Two pressing gaps are again also provided in a machine of the initially named kind which is known from DE-A-196 54 197. The rearwardly lying main press is formed by a shoe pressing unit and a drying cylinder.

Thus, in the known machines two or more pressing gaps are always provided. This is considered to be imperative in order to achieve on the one hand a careful dewatering without a squashing, which is demanded in particular in the manufacture of a tissue paper or hygienic paper web, and on the other hand an improved production performance through an increased dry content after the press. In this a careful dewatering of the web without a squashing is achieved with the complete or partial replacing of the roller gap presses by shoe presses as a result of the corresponding gap lengthening or the increase in the pressing time respectively.

A substantial disadvantage of known embodiments includes the relatively high investment and operating costs in comparison with the improvements achieved. In view of the previously usual limiting of the maximum line force to a value in the region of 90 kN e.g. for Yankee cylinders it was always necessary in the known press designs to provide at least two pressing gaps.

SUMMARY OF THE INVENTION

The present invention provides a machine and a method as generally discussed above in which as high a dry content and/or specific volume can be achieved while avoiding the above named disadvantages and while largely retaining the quality features which are demanded of the produced web.

In a dewatering press of a machine which serves for the manufacture of a paper and/or cardboard web and which is described in EP-A2-0 852 273 the dwell time of the web in a prolonged pressing gap amounts to less than 12 ms.

In accordance with the invention, the machine includes at least one pressing gap (nip) which is formed between a shoe pressing unit and the drying or tissue cylinder respectively. The length of this pressing gap when viewed in the direction of travel of the web is less than or equal to a value of approximately 60 mm and the resulting pressure profile over the pressing gap length has a maximum pressing pressure which is greater than or equal to a value of approximately 3.3 MPa.

A completely unexpected significant increase both in the dry content and also in the specific volume of the fiber material web is achieved with a development of this kind. This is all the more surprising as the proposed solution departs from the course which was previously taken in the press development, the goal of which was, with the replacement of the roller gap presses by shoe pressing with a prolonged pressing gap, in effecting a careful, slow dewatering as a prerequisite for ideal results. As a result of the development in accordance with the invention many tissue paper machines can now be realized with only one single shoe pressing gap.

In a preferred practical embodiment of the machine in accordance with the invention the pressing gap length is less than or equal to a value of approximately 50 mm and the maximum pressing pressure is greater than or equal to a value of approximately 4.3 MPa. The pressing gap length is defined as he contacted length between the drying cylinder and the associated pressing element and the new carrier band which is passing through.

In this the specific volume is likewise slightly increased. An increase of this kind can for example amount to approximately 5%. A considerable increase is arrived at with respect to the dry content, which holds in particular in comparison with a pressing gap which is formed by a suction pressing roller or by a shoe press with a gap length of for example 120 mm. In this case for example an increase in the dry content by approximately 2.5 to 3% is possible if a constant line force of approximately 90 kN/m is assumed. A value of this kind must not be exceeded in the previously usual Yankee cylinders in view of a maximum permissible mechanical stressing. The invention can thus be used with particular advantage in particular in conversions of existing presses. Thus dry content increases and constant or even higher values of the specific volume (bulk) can be achieved in comparison with the conventional presses in spite of a respective line force limiting.

In a further expedient embodiment the pressing gap length lies in a region of approximately 37 mm and the maximum pressing pressure in a region of approximately 4.8 MPa.

With short shoes it turned out that the angle between the tangent which is applied at the end of the pressing gap to the drying or tissue cylinder respectively and the carrier band which emerges from the pressing gap has a significant influence on the dry content of the tissue web. An advantageous embodiment is distinguished in that in particular for the manufacture of a tissue web this angle between the tangent which is applied at the end of the pressing gap to the drying or tissue cylinder respectively and the carrier band which emerges from the pressing gap is $\geqq 10°$, in particular is $\geqq 18°$ and is preferably $\geqq 20°$. With this there results a dry content increase of approximately 1 to 3% in comparison with applications with suction pressing rollers. In this the pressing band is preferably grooved and/or blind bored.

In accordance with an alternative embodiment of the machine in accordance with the invention, at least one pressing gap is formed between a shoe pressing unit and the drying or tissue cylinder respectively. The length of the at least one pressing gap when viewed in the direction of travel of the web is greater than a value of approximately 80 mm and preferably less than 200 mm, in particular at most 150 mm. The pressure profile which results over the pressing gap length has a maximum pressing pressure which is less than or equal to a value of approximately 2 MPa. In this account is also taken in particular of the fact that in longer shoes the dry content which can be achieved, contrary to expectation, decreases.

In particular in this case it is advantageous when the dwell time of the fiber material web in the pressing gap is greater than or equal to a value of for example approximately 3.5 ms and is in particular greater than or equal to 4 ms. In this the dwell time can in particular be defined by the ratio of the gap or shoe length respectively to the web speed.

The maximum line force which is produced by the pressing gap can lie for example in a range from approximately 90 to approximately 120 kN/m.

In an advantageous practical embodiment of the machine in accordance with the invention the shoe pressing unit includes a pressing shoe which can be pressed against the drying cylinder via a plurality of pressing elements which are arranged adjacently to one another and transversely (cross-wise) to the direction of travel of the web. With this a respective desired pressing force profile can be set in particular at the web edges for the uniformization of the web properties.

A crepe cylinder, i.e. a so-called Yankee cylinder can in particular be provided as a drying cylinder.

The pressure profile which results over the pressing gap length is preferably asymmetrical.

If the pressing gap length is less than or equal to a value of approximately 60 mm and if the pressure profile has a maximum pressing pressure which is greater than or equal to a value of approximately 3.3 MPa, then the maximum pressing pressure expediently lies in the rear half of the pressing gap length when viewed in the direction of travel of the web.

If on the other hand the pressing gap length is greater than a value of approximately 80 mm and if the pressure profile has a maximum pressing pressure which is less than or equal to a value of approximately 2 MPa, then the maximum pressing pressure can lie in particular in the rear quarter of the pressing gap length when viewed in the direction of travel of the web.

In particular in a pressing gap length which is less than or equal to approximately 60 mm, it is advantageous when the average pressure increase gradient in the section of the pressure profile which extends from the gap beginning up to the maximum pressing pressure in a practically new carrier band is greater than or equal to a value of approximately 40 kPa/mm, in particular is greater than or equal to approximately 60 kPa/mm and is preferably greater than or equal to approximately 120 kPa/mm.

The average pressure decrease gradient in the end region of the pressure profile in a practically new carrier band is preferably greater than or equal to a value of approximately 300 kPa/mm, in particular is greater than or equal to approximately 500 kPa/mm and is preferably greater than or equal to approximately 800 kPa/mm. The average pressure decrease gradient in the end region increases with increasing operating time of the felt. Through this, values of more than 1000 to more than 1600 kPa/m are achieved in a pressing gap in accordance with the invention.

In a preferred practical embodiment the water absorbent carrier band lies in the pressing gap between the water-impermeable pressing band and the fiber material web, with the fiber material web making contact with the drying cylinder.

A felt can be provided in particular as a water absorbent carrier band. A felt of this kind can for example have an areal weight which is less than or equal to a value of approximately 1450 g/m$^2$. For example a felt which is structured in a particular manner as a kind of imprinting sieve or felt which is provided with protuberances, i.e. of a so-called "imprinting fabric" or "imprinting felt" (see for example W098/00604)) or of a "patterning fabric" or "patterning felt" having a coarsely structured surface can be used. The special carrier bands have an advantageous effect on the specific volume of the produced paper web in particular in combination with a pressing gap in accordance with the invention which has a pressing gap length which is greater than or equal to approximately 80 mm.

The water absorbent carrier band can have a different constitution in the thickness direction. Thus the side of the carrier band which faces the fiber material web can for example have a finer structure than its side which faces away from the fiber material web.

In an expedient practical embodiment the pressing band has a surface which is grooved and/or is provided with blind bores, such as is described for example in DE-A-196 54 198.

In principle a further pressing gap can also be formed at the drying cylinder. In this it can be expedient in certain uses when at least two pressing gaps are provided at the drying cylinder which are formed by a respective shoe pressing unit. In principle it is also conceivable to provide an additional pressing gap ahead of the drying cylinder in the direction of travel of the web.

In an expedient practical embodiment of the machine in accordance with the invention the carrier band and the fiber material web are led over at least one suction device ahead of the drying cylinder in the direction of travel of the web, through which then a corresponding pre-dewatering takes place. In this at least one suction device or suction box respectively can expediently be provided which includes a suction roller and/or a suction shoe.

In a preferred practical embodiment of the machine in accordance with the invention a shoe pressing roller is provided as a shoe pressing unit.

It is also advantageous when the shoe pressing unit includes at least one replaceable pressing shoe.

The method, in accordance with the invention in which the fiber material web to be dewatered is passed together with a carrier band through the pressing gap, includes the fiber material web to be dewatered is subjected to a maximum pressing pressure in the pressure plot of at least 3.3 MPa in the pressing gap for a time duration of at most 3 ms. In this the time duration or dwell time respectively of the fiber material web in the pressing gap is defined by the ratio of the gap length to the web speed.

In an alternative variant embodiment of the method in accordance with the invention in which the fiber material web to be dewatered is passed through a pressing gap together with a band, the fiber material web to be dewatered is subjected to a pressing pressure of at most 2 MPa in the pressing gap for a time duration of at least 3.5 ms.

The invention can be used for example for a crescent former, a long sieve tissue paper machine, a double sieve former, a suction breast roller machine etc.

The input material for the manufacture for example of a tissue web can for example consist of refined pulp. Here the pressing gap in accordance with the invention can be particularly advantageously used for increasing the dry content.

A material input of this kind which serves for example for the manufacture of a tissue web can however also include unrefined pulp. In this case the long pressing gap in accordance with the invention can particularly advantageously be used for increasing the specific volume.

The invention can for example also be used for so-called "curled fibers". The pulp suspension contains in this case a proportion of fibers which were subjected to a special treatment. In this the celluloid fibers, which are substantially straight or curved in a plane respectively, are curved in such a manner that a spatial fiber shape for example in the manner of a helix arises.

The invention can in particular also be used in a tissue paper machine including at least one so-called "through-air-drying" process, with the pressing gap in accordance with the invention in particular being used ahead of a corresponding "through-air-drying" device. A combination of this kind is advantageous in particular in regard to a high dry content and to a high specific volume. Through the pressing gap in accordance with the invention on the one hand a high dry content is thereby achieved, through which the operating costs of the energy-intensive drying phase are reduced. On the other hand the web is at most slightly condensed, which means that the specific volume of the web is increased or, respectively, remains unimpaired at higher pressing pressures, through which in particular the "through-air-drying" process also becomes more efficient and more economical.

The invention can also be used in particular in the manufacture of multiple layer webs using a single headbox or of the manufacture of multiple layer webs using a plurality of headboxes.

The present invention is directed to machine for the manufacture of a fiber material web. The machine includes a shoe pressing unit, and a cylinder comprising one of a drying and tissue cylinder. The shoe pressing unit and the cylinder are arranged to form at least one press nip. A water absorbent carrier band and a water-impermeable pressing band are provided such that the water absorbent carrier band and the water-impermeable pressing band are guided through the at least one press nip, and the fiber material web is adapted to pass through the at least one press nip with the water absorbent carrier band and the water-impermeable pressing band. The at least one press nip has a length in a web travel direction of less than or equal to approximately 60 mm. A pressure profile which results over the press nip length has a maximum pressing pressure which is greater than or equal to approximately 3.3 MPa.

According to a feature of the present invention, the press nip length can be less than or equal to approximately 50 mm and the maximum pressing pressure can be greater than or equal to approximately 4.3 MPa.

In accordance with another feature of the instant invention, the water-impermeable pressing band may be at least one of grooved and blind bored.

According to still another feature of the invention, the fiber material web can include one of a tissue paper and a hygienic paper web.

The maximum pressing pressure can be exerted in a rear half of said press nip length with regard to the web travel direction.

The present invention is directed to a process for the manufacture of a fiber material web, including passing the fiber material web to be dewatered through a press nip together with a carrier band, and subjecting the fiber material web to be dewatered to a pressing pressure of at least 3.3 MPa in the press nip for a time duration of at most 3 ms.

In accordance with a feature of the invention, the fiber material web can include one of a tissue paper and a hygienic paper web.

Further, the fiber material web can include curled fibers.

The present invention is directed to a process for the manufacture of a fiber material web, that includes passing the fiber material web to be dewatered through a press nip together with a band and subjecting the fiber material web to be dewatered to a pressing pressure of at most 2 MPa in the press nip for a time duration of at least 3.5 ms.

BRIEF DESCRIPTION OF THE DRAWINGS

The invention will be explained in more detail in the following with reference to exemplary embodiments and with reference to the drawings; shown in these are.

DETAILED DESCRIPTION OF THE PRESENT INVENTION

Figure 1:
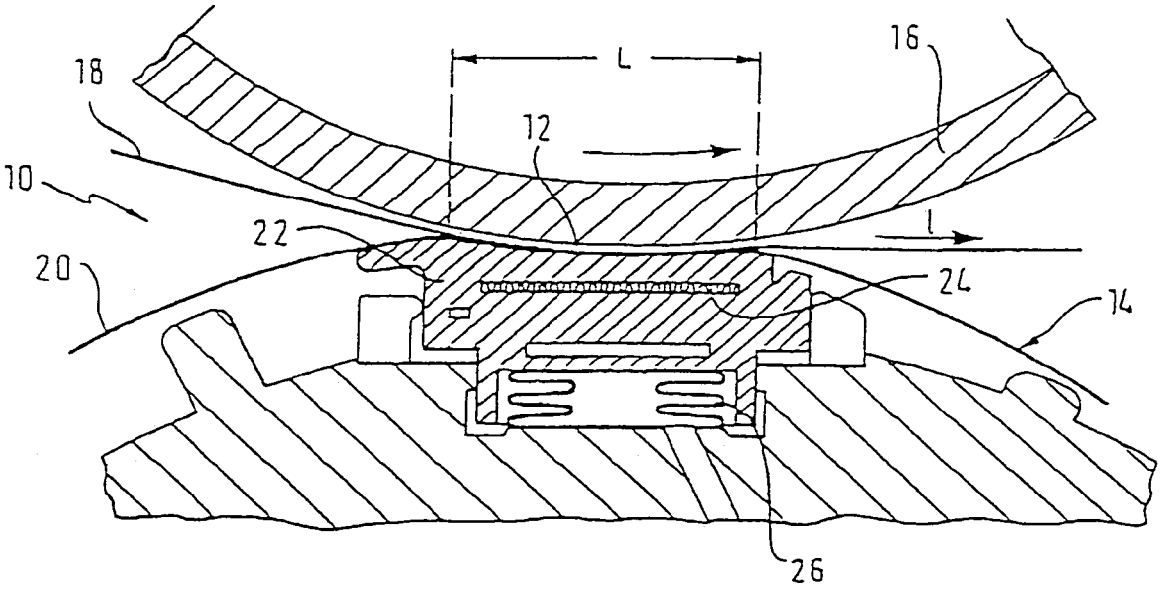
FIG. 1 a purely schematic partial illustration of a shoe press in accordance with the invention having a pressing gap which is formed between a shoe pressing unit and a drying cylinder, FIG. 2 the pressing pressure plot of a conventional shoe press, FIG. 3 the pressing pressure plot of an exemplary embodiment of the shoe press in accordance with the invention having a relatively short pressing shoe, FIG. 4 a comparison of the pressing pressure plot of an exemplary embodiment of the shoe press in accordance with the invention having a relatively short pressing shoe with the pressing pressure plot of a conventional press which is provided with a suction pressing roller, FIG. 5 a comparison of the pressing pressure plot of an exemplary embodiment of the shoe press in accordance with the invention having a relatively long pressing shoe with the pressing pressure plot of a conventional press which is provided with a suction pressing roller, FIG. 6 the specific volume as a function of the dry content, with the results obtained for an exemplary embodiment of the shoe press in accordance with the invention which have a relatively short pressing shoe being com-pared with those for a conventional press which is provided with a suction pressing roller, FIG. 7 the specific volume as a function of the dry content, with the results obtained for an exemplary embodiment of the shoe press in accordance with the invention which have a relatively long pressing shoe being com-pared with those for a conventional press which is provided with a suction pressing roller, and FIG. 8 a purely schematic partial illustration of a further embodiment of the shoe press in accordance with the invention having a pressing gap which is formed between a shoe pressing unit and a tissue cylinder.

FIG. 1 shows in a purely schematic partial illustration an exemplary embodiment of a shoe press 10 in accordance with the invention which can for example be used in a machine for the manufacture of a fiber material web such as in particular a tissue paper or hygienic paper web.

The pressing gap (press nip) 12 of this shoe press 10 is formed between a shoe pressing unit, in the present case a shoe pressing roller (shoe press roll) 14, and a drying cylinder 16, through which in addition to the fiber material web a water absorbent carrier band 18 and a water-impermeable pressing band are passed through, which in the present case is the pressing jacket 20 of the shoe pressing roller 14. The water absorbent carrier band 18 can in particular be formed by a felt. In the present case the water absorbent carrier band 18 is passed through the pressing gap 12 between the pressing jacket 20 and the fiber material web, with the fiber material web making contact with the drying cylinder 16.

As can be recognized with reference to FIG. 1, the shoe pressing roller 14 has a two-part pressing shoe 22, between the two parts of which a thermal insulation layer 24 is inserted.

The pressing shoe 22 can be pressable against the drying cylinder 16 via a plurality of pressing elements 26 which are arranged adjacently to one another and transversely (crosswise) to the direction of travel of the web 1.

The drying cylinder 16 can for example be a Yankee cylinder.

The water absorbent carrier band 18 which is formed for example by a felt can have a different constitution in the thickness direction. In this for example the side of the carrier band 18 which faces the fiber material web can have a finer structure than that of the side which faces away from the fiber material web. The pressing jacket 20 can have a surface which is smooth, is grooved and/or is provided with blind bores. At least one further pressing gap, which is not illustrated here, can be formed at the drying cylinder 16. An additional pressing gap can be provided ahead of the drying cylinder 16 in direction of travel of the web 1. In principle the carrier band 18 and the fiber material web can also be guided over at least one suction device ahead of the drying cylinder 16 in the direction of travel of the web 1. The shoe pressing unit 14 can comprise at least one replaceable pressing shoe 22.

Figure 2:
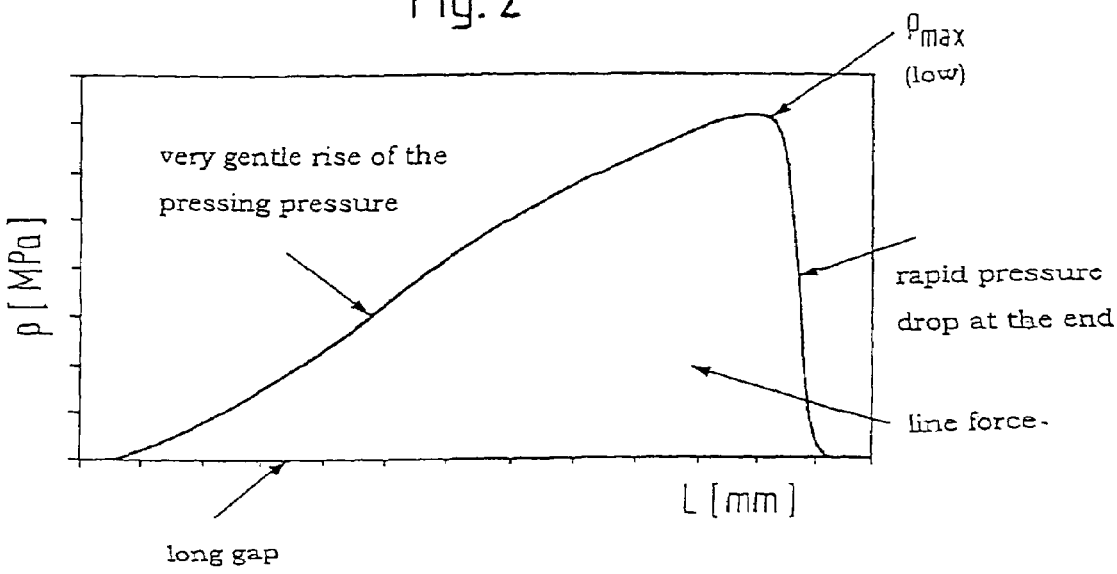

In FIG. 2 the pressure profile or the pressing pressure plot p(L) respectively of a conventional shoe press is illustrated. In this the pressing pressure p is plotted as a function of the length L of the pressing gap 12 or of the pressing shoe 22 respectively.

In a conventional long gap of this kind there results at first a very gentle pressure increase up to a relatively low maximum pressing pressure pmax. Following the maximum pressing pressure pmax of this pressure plot p(L) a rapid drop in pressure then takes place.

The shoe press 10 in accordance with the invention can now be designed in particular in such a manner that the length L of the pressing gap 12 (cf. 20 FIG. 1) when viewed in the direction of travel of the web 1 is less than or equal to a value of approximately 60 mm and its pressure profile p(L) which results over the pressing gap length L has a maximum pressing pressure pmax which is greater than or equal to a value of approximately 3.3 MPa.

Figure 3:
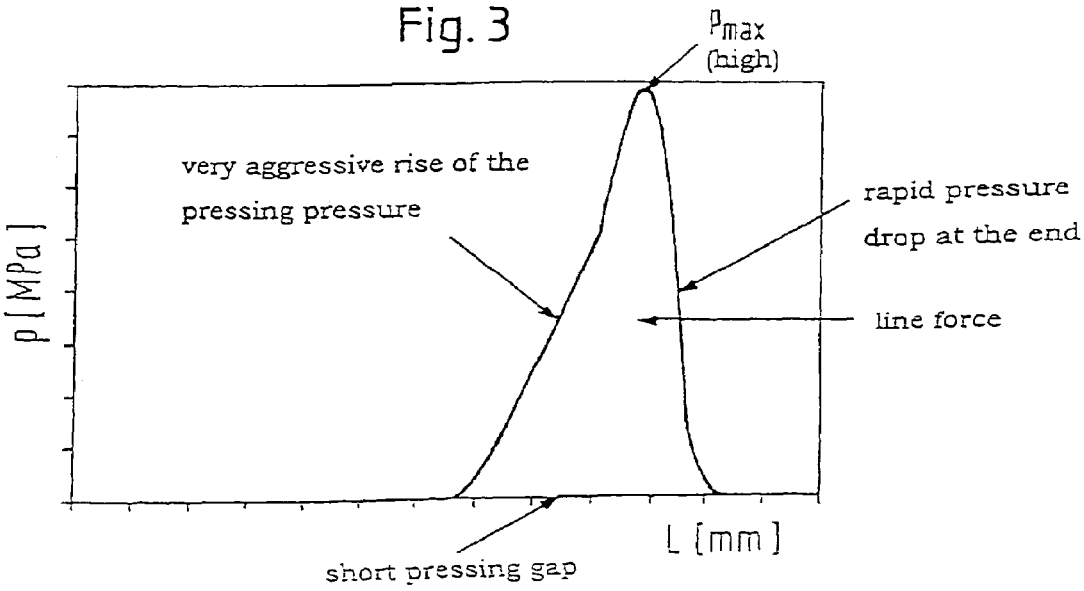

In FIG. 3 now the pressing pressure plot p(L) of an exemplary embodiment of a shoe press 10 in accordance with the invention of this kind having a relatively short pressing shoe 22 is illustrated. In this, starting from the gap beginning, there first results an extreme rise in the pressing pressure up to a relatively high maximum pressing pressure pmax. Following this maximum pressing pressure pmax the pressing pressure then falls off very rapidly in the end region.

With reference to FIG. 3 it can be recognized that the pressure profile p(L) which results over the pressing gap length L is asymmetrical. In this the maximum pressing pressure pmax lies in the rear half of the pressing gap length L when viewed in the direction of travel of the web 1.

Figure 4:
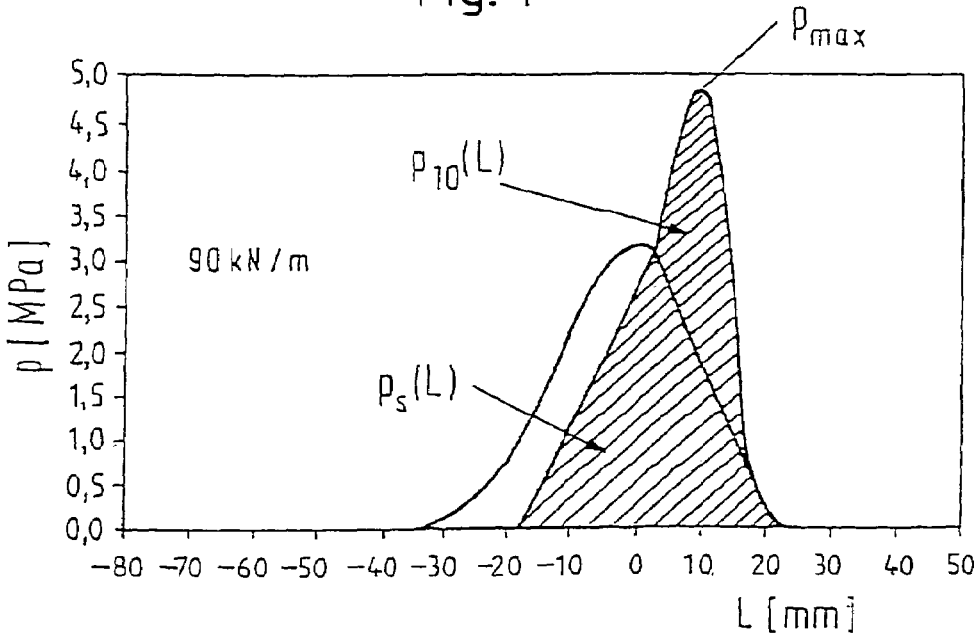

FIG. 4 shows a comparison of the pressing pressure plot plo (L) of an exemplary embodiment of the shoe press 10 in accordance with the invention having a relatively short pressing shoe 12 with the pressing pressure plot ps (L) of a conventional press which is provided with a suction pressing roller. In contrast to the conventional press there results in particular a shorter pressing gap and a higher maximum pressing pressure pmax. In the present case the maximum line force which was produced in the pressing gap amounted in each case to 90 kN/m.

In an alternative variant embodiment of the shoe press 14 in accordance with the invention the length L of the pressing gap 12 (cf. FIG. 1) when viewed in the direction of travel of the web 1 can be greater than a value of approximately 80 mm and its pressure profile pi, which results over the pressing gap length L can have a maximum pressing pressure pmax which is less than or equal to a value of for example approximately 2 MPa. In this the maximum line force which is produced in the pressing gap can lie in particular in a range from approximately 90 to approximately 110 kN/m. At higher maximum line forces, such as are normally no longer possible in the usual, not additionally reinforced Yankee cylinders, (cf. e.g. the high value of 270 kN/m which is still given in FIG. 5), a higher maximum pressing pressure pmax is also conceivable.

Figure 5:
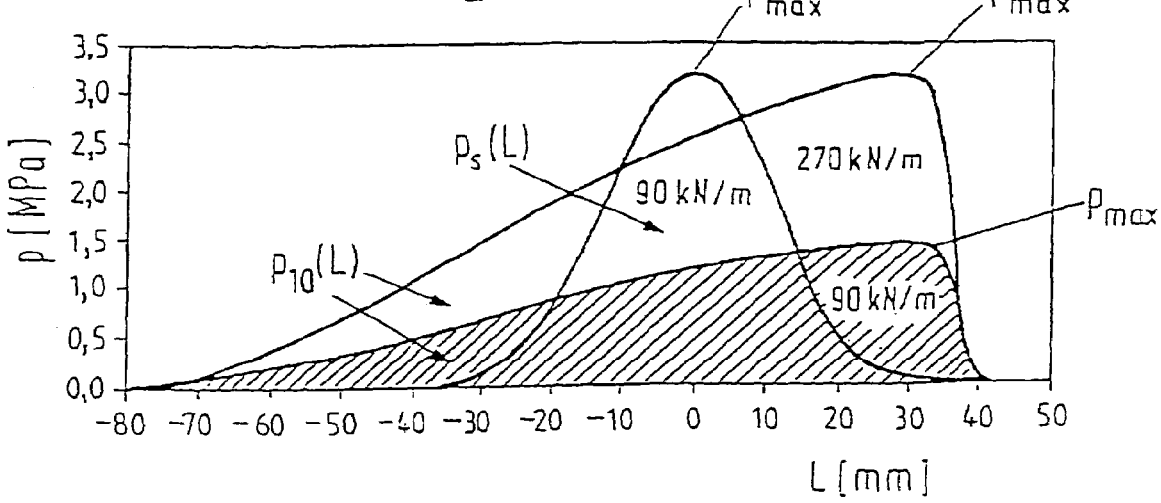

FIG. 5 shows a comparison of the pressing pressure plot p10 (L) of an exemplary embodiment of a shoe press 10 in accordance with the invention of this kind having a relatively long pressing shoe 12 with the pressing pressure plot ps (L) of a conventional press which is provided with a suction pressing roller.

Whereas the pressing pressure plot p10 (L) of the shoe press in accordance with the invention is illustrated both for a maximum line force of 90 kN/m and for a higher maximum line force of 270 kN/m, the pressing pressure plot ps (L) of the conventional press is illustrated merely for a maximum line force of 90 kN/m.

In accordance with this FIG. 5 there results in the shoe press 10 in accordance with the invention a significantly longer pressing gap 12. In addition the corresponding pressing pressure plot pio (L) has a significantly lower maximum pressing pressure pmax (cf. the hatched lower pressing pressure plot p10 (L) which is given for a maximum line force of 90 kN/m). It can also be seen in FIG. 5 that even at a substantially higher maximum line force of 270 kN/m here the maximum pressing pressure pmax is not greater than the maximum pressing pressure pmax of the conventional press, for which in the present case a maximum line force of 90 kN/m is given.

Figure 6:
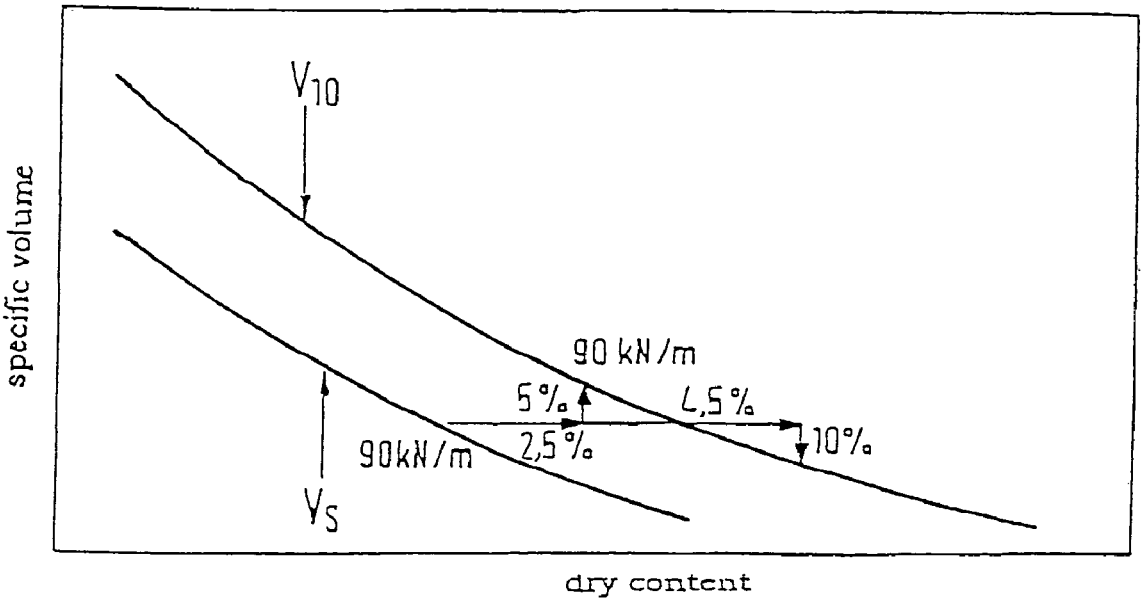

FIG. 6 shows the specific volume as a function of the dry content, with the results $V_{10}$ which were obtained for an exemplary embodiment of the shoe press 10 in accordance with the invention which has a relatively short pressing shoe 22 again being compared with the results Vs for a conventional press which is provided with a suction pressing roller. If one first assumes in both cases a constant maximum line force of 90 kN/m, then for example an increase of the dry content by 2.5% and an increase of the specific volume by 5% can be achieved in comparison with to the conventional press. With a greater maximum line force of for example 270 kN/m, for example a further increase of the dry content by 4.5% can be achieved, that is, a total of 2.5%+4.5%=7% more than with the conventional suction pressing roller, with it being necessary to take only 10% in specific volume into the bargain in this case.

Figure 7:
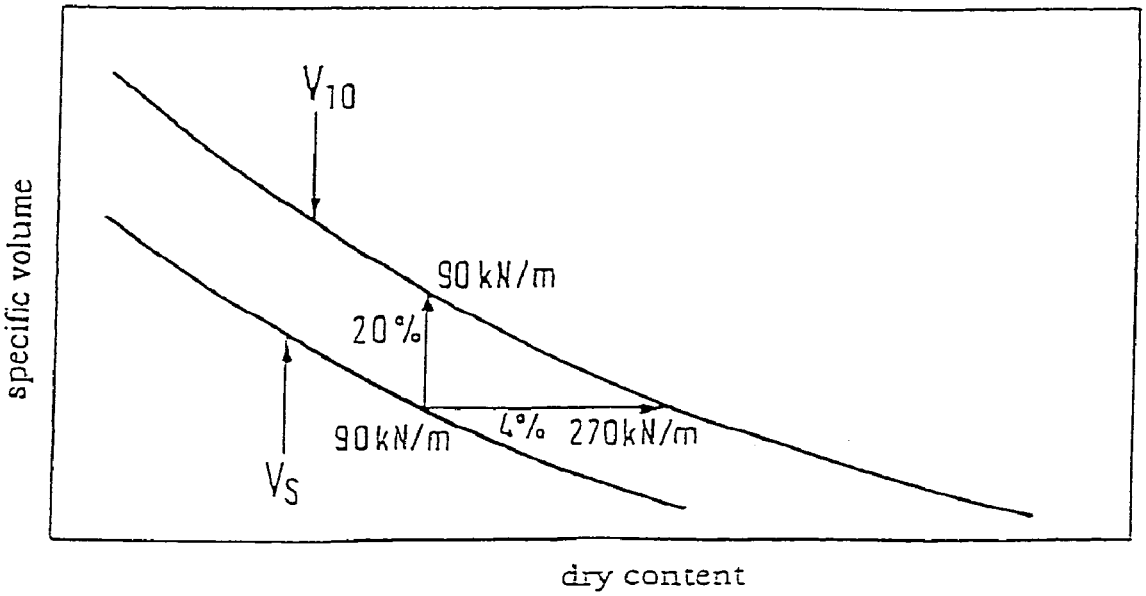

FIG. 7 shows the specific volume as a function of the dry content, with the results $V_{10}$ obtained for an exemplary embodiment of the shoe press 10 in accordance with the invention which has a relatively long pressing shoe 12 again being compared with the results Vs for a conventional press which is provided with a suction pressing roller.

If a constant maximum line pressure of 90 kN/m is assumed, then an increase of the specific volume of 20% can achieved with the same dry content, through which a correspondingly higher quality results. In contrast to this, an increase in the dry content by 4% can be achieved at a same specific volume, through which energy can be saved or a higher production rate can be achieved. As can be recognized with reference to FIG. 7, a constant maximum line force of 270 kN/m is assumed here.

Figure 8:
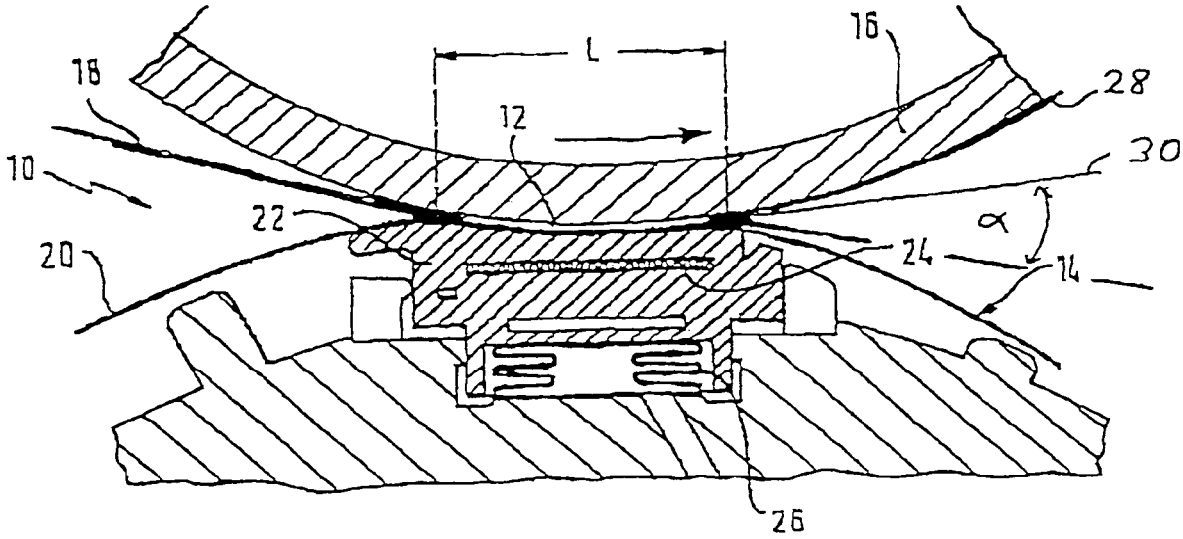

FIG. 8 shows in a schematic partial illustration a further exemplary embodiment of a shoe press 10 in accordance with the invention.

In the case of short shoes 22 it has proved that the angle a between the tangent 30 which is applied at the end of the pressing gap 12 to the drying or tissue cylinder 16 respectively and the carrier band 18 which emerges from the pressing gap 12 has a substantial influence on the dry content of the tissue web 28. The present embodiment is now distinguished in that in particular for the manufacture of a tissue web 28 this angle α between tangent 30 which is applied at the end of the pressing gap 12 to the drying or tissue cylinder 16 respectively and the carrier band 18 which emerges from the pressing gap 12 is ≧10°, in particular is ≧18° and is preferably ≧20°. With this there results an increase in dry content of approximately 1 to 3% in contrast with applications with suction pressing rollers. The pressing band 18 is preferably grooved and/or blind bored.

Otherwise the present shoe press 10 again has for example the same construction as that in accordance with FIG. 1. Mutually corresponding elements are provided with the same reference symbols.

LIST OF REFERENCE SYMBOLS

10 shoe press
12 pressing gap
14 shoe pressing roller
16 drying cylinder
18 carrier band
20 pressing band, pressing jacket
22 pressing shoe
24 thermal insulation layer
26 pressing element
28 tissue web
30 tangent
L pressing gap length
1 direction of travel of the web
p(L) pressing pressure plot, pressure profile
Pmax maximum pressing pressure
α angle

What is claimed:

1. A machine for the manufacture of a fiber material web, comprising:

a shoe pressing unit;

a cylinder comprising one of a drying and tissue cylinder, wherein said shoe pressing unit and said cylinder are arranged to form at least one press nip;

a water absorbent carrier band;

a water-impermeable pressing band, wherein said water absorbent carrier band and said water-impermeable pressing band are guided through said at least one press nip, and the fiber material web is adapted to pass through said at least one press nip with said water absorbent carrier band and said water-impermeable pressing band; and said at least one press nip having a length in a web travel direction of less than or equal to approximately 60 mm, wherein a pressure profile which results over said press nip length has a maximum pressing pressure which is greater than or equal to approximately 3.3 MPa, and wherein an angle between a tangent at the end of the at least one press nip and the water absorbent carrier band is greater than 10°.

2. The machine in accordance with claim 1, wherein said press nip length is less than or equal to approximately 50 mm and the maximum pressing pressure is greater than or equal to approximately 4.3 MPa.

3. The machine in accordance with claim 2, wherein said water-impermeable pressing band is at least one of grooved and blind bored.

4. The machine in accordance with claim 3, wherein the fiber material web comprises one of a tissue paper and a hygienic paper web.

5. The machine in accordance with claim 1, wherein the maximum pressing pressure is exerted in a rear half of said press nip length with regard to the web travel direction.

* * * * *